US007891708B2

(12) United States Patent
Panizza

(10) Patent No.: US 7,891,708 B2
(45) Date of Patent: Feb. 22, 2011

(54) DEVICE FOR COUPLING AND RELEASING THE WRIST STRAP TO/FROM THE HANDGRIP OF A POLE FOR SPORTING ACTIVITIES

(75) Inventor: Paolo Panizza, Bassano del Grappa (VI) (IT)

(73) Assignee: GABEL S.r.l., Rosà (VI) (IT)

( * ) Notice: Subject to any disclaimer, the term of this patent is extended or adjusted under 35 U.S.C. 154(b) by 457 days.

(21) Appl. No.: 11/972,191

(22) Filed: Jan. 10, 2008

(65) Prior Publication Data

US 2008/0169635 A1 Jul. 17, 2008

(30) Foreign Application Priority Data

Jan. 15, 2007 (IT) ..... VI07A0012

(51) Int. Cl.
*A63C 11/00* (2006.01)
*A45B 9/02* (2006.01)
*A45C 13/22* (2006.01)

(52) U.S. Cl. ..... 280/822; 280/821; 135/72; 135/76; 16/428

(58) Field of Classification Search ..... 280/819, 280/821, 822, 826; 135/76, 72, 65; 16/428
See application file for complete search history.

(56) References Cited

U.S. PATENT DOCUMENTS 3,560,014 A * 2/1971 Bruckl et al. ..... 280/821
6,264,242 B1 * 7/2001 Lenhart ..... 280/822
6,325,418 B1 * 12/2001 Lenhart ..... 280/821
RE38,573 E * 8/2004 Wells ..... 280/822
7,226,084 B2 * 6/2007 Lenhart ..... 280/822
7,661,713 B2 * 2/2010 Panizza ..... 280/821
7,665,769 B2 * 2/2010 Lenhart ..... 280/822

FOREIGN PATENT DOCUMENTS

DE 202006011105 U1 10/2006
EP 0370900 A1 5/1990
EP 1491241 A1 12/2004
FR 2668378 A 4/1992

* cited by examiner

*Primary Examiner*—J. Allen Shriver, II
*Assistant Examiner*—John R Olszewski
(74) *Attorney, Agent, or Firm*—IP Strategies

(57) ABSTRACT

The invention is a device for coupling and releasing the wrist strap to/from the handgrip of a pole for sporting activities, comprising: a buckle associated with the wrist strap; a seat obtained in the handgrip to house the buckle; means for coupling the buckle comprising an elastic tab that projects from the body of the buckle and a support surface obtained in the seat that cooperate by mutual contact when the buckle is constrained to the handgrip; means for coupling the buckle that can be maneuvered by the user. The releasing means comprise a release lever that can be maneuvered by the user and is housed inside the seat, wherein in said release lever it is possible to identify a central core with a rotation pin, a maneuvering end that can be reached by the user and a release end that cooperates by contact with the elastic tab to move it away from the support surface.

19 Claims, 7 Drawing Sheets

DEVICE FOR COUPLING AND RELEASING THE WRIST STRAP TO/FROM THE HANDGRIP OF A POLE FOR SPORTING ACTIVITIES

BACKGROUND OF THE INVENTION

The present invention relates to a device for coupling and releasing the wrist strap to/from the handgrip of a pole for sporting activities, e.g. skiing, trekking and the like.

It is known that the poles that are used in the sporting activities mentioned above substantially comprise an elongated tubular body that is provided at one end with a tip and at the opposite end with a handgrip that is grasped by the user.

The handgrip is associated with a wrist strap provided with a buckle that is inserted in a seat obtained in the handgrip and secured thereto by suitable coupling means.

The buckle is extracted from the seat by the user, with the aid of suitable releasing means provided on the handgrip.

According to the known technique, the coupling means and the releasing means are carried out with different configurations, all aimed to make the coupling and releasing operations quick and easy.

Furthermore, the releasing means need to be operated intentionally by the user.

One of the drawbacks that sometimes can be noticed in known embodiments lies in that the releasing means can be operated even unintentionally by the operator, which goes to the detriment of safety.

SUMMARY OF THE INVENTION

The present invention intends to propose a device for coupling and releasing the wrist strap to/from the handgrip of a pole for sporting activities that is substantially different from the embodiments of known type.

Another object of the present invention is to propose a device that is simple and economic to produce.

Another, yet not the least object of the invention is to construct a device that is safer than the known devices against accidental release.

The objects mentioned above are achieved by a device for coupling and releasing the wrist strap to/from the handgrip of a pole for sporting activities, e.g. skiing, trekking and the like, carried out according to the contents of the main claim.

Other details of the invention are described in the corresponding dependent claims.

As will be described in greater detail below, the device that is the subject of the invention comprises a buckle that is removably fitted, through sliding insertion, into a seat obtained in the handgrip, connection thereto being ensured by coupling means comprising elastic elements.

The releasing means include a lever hinged to the handgrip that can be maneuvered by the user and interacts with the above mentioned elastic elements.

The invention also includes safety means, which can be connected and disconnected by the user, suited to prevent the accidental release of the wrist strap from the handgrip.

To advantage, the device of the invention is more reliable than the devices carried out according to the known art.

BRIEF DESCRIPTION OF THE DRAWINGS

The objects and advantages described above will be better highlighted in the description of preferred embodiments of the invention which are illustrated below with reference to the attached drawings, wherein.

Figures 1, 2, 3:
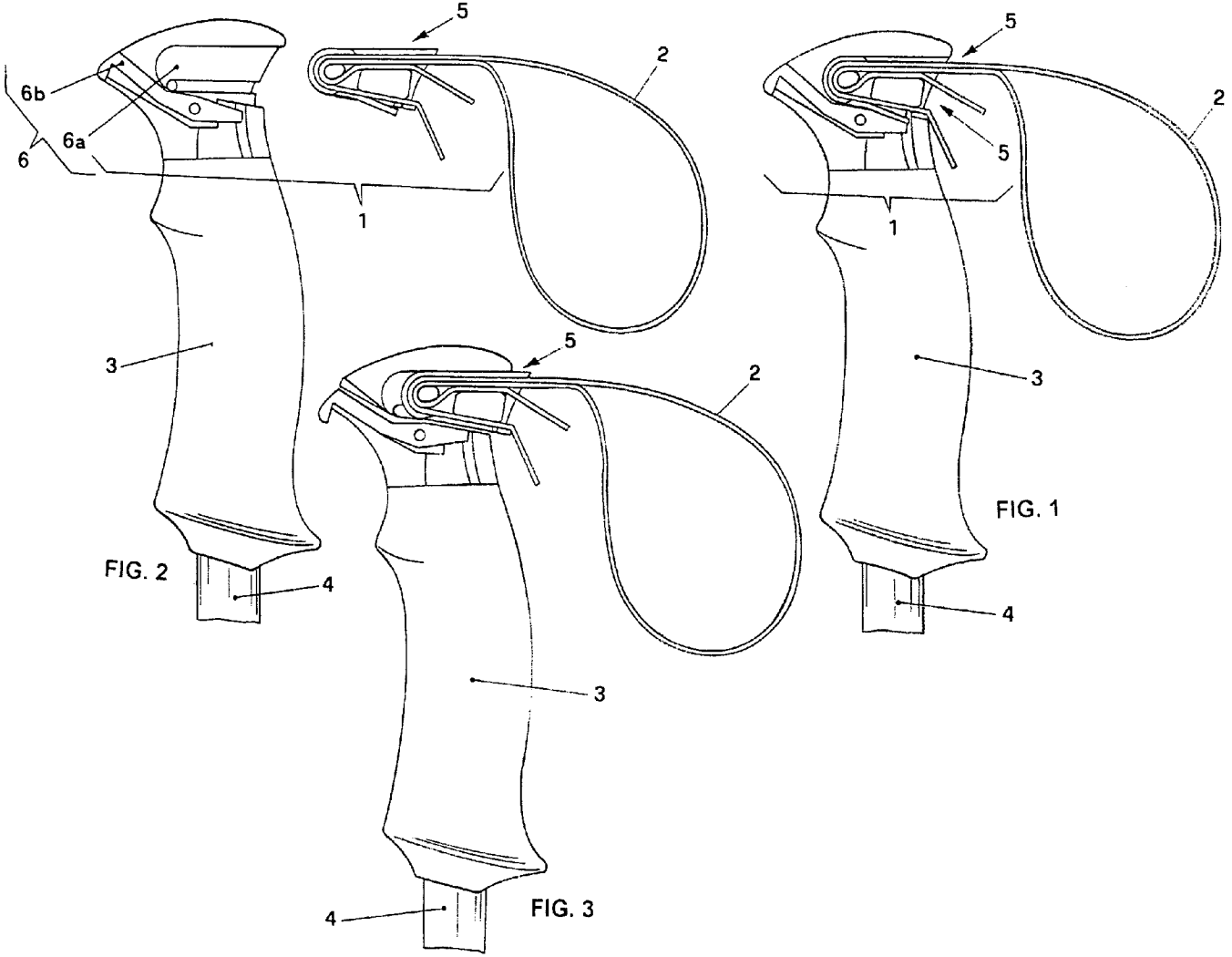
FIG. 1 shows a partial section view of the handgrip of a pole for sporting activities, e.g. skiing, trekking and the like, with a corresponding device for coupling and releasing the wrist strap to/from the handgrip, said device being the subject of the invention.
FIG. 2 shows the handgrip of FIG. 1 with the wrist strap disconnected from the handgrip.
FIG. 3 shows the handgrip of FIG. 2 while the wrist strap is being released from the handgrip.
Figure 4:
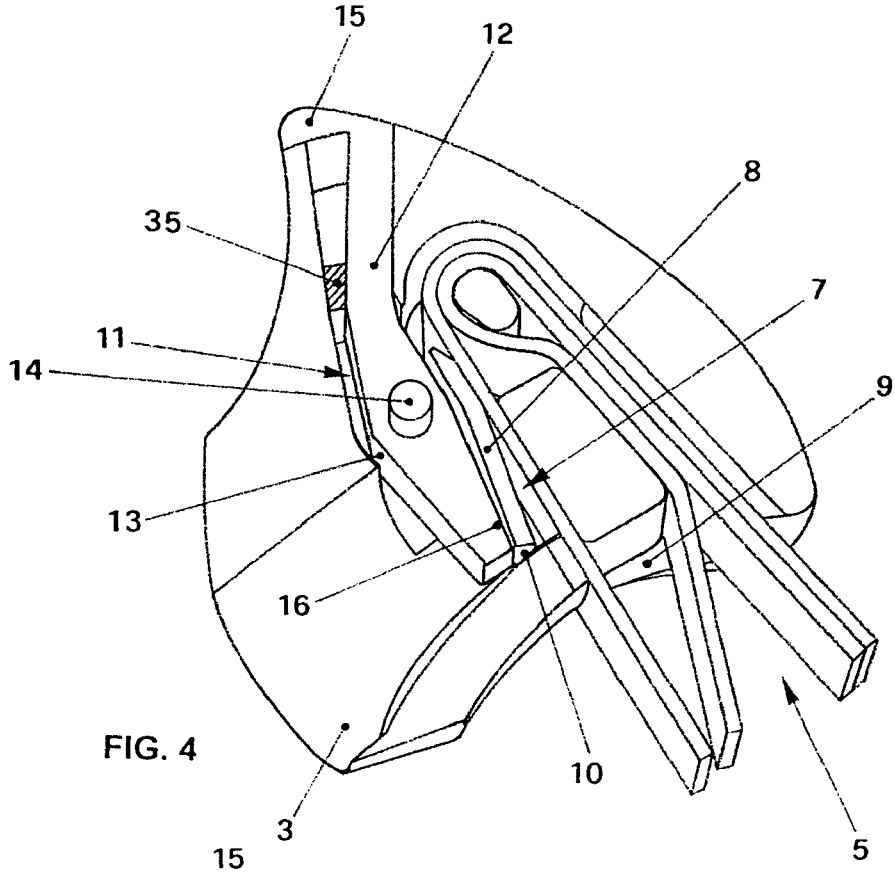
FIG. 4 shows an axonometric view of a detail of FIG. 1.
Figure 5:
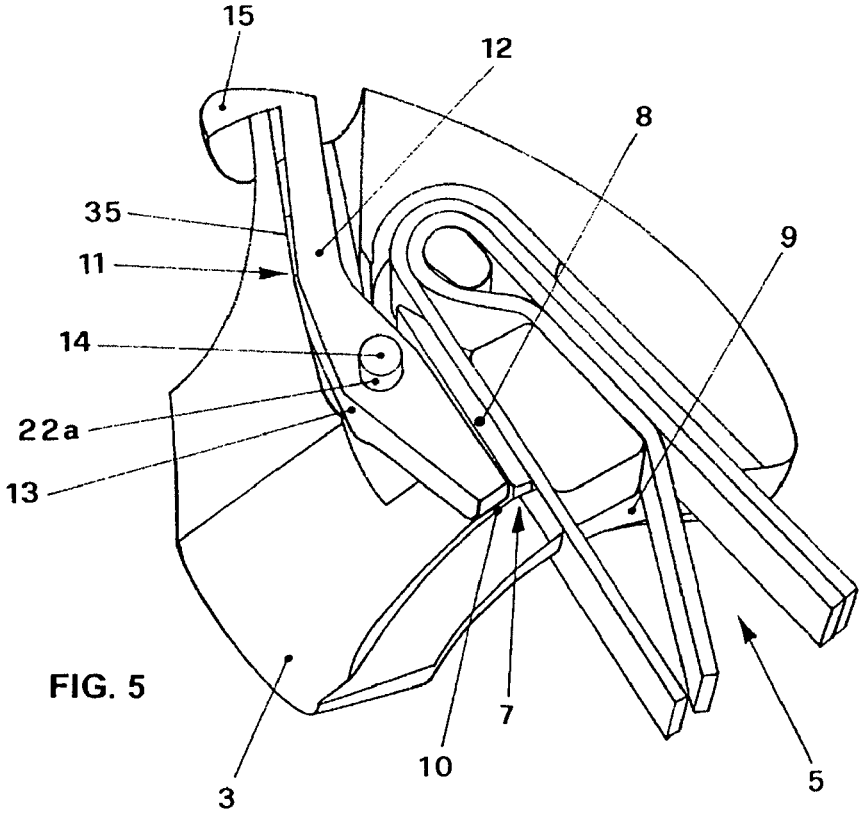
FIG. 5 shows an axonometric view of a detail of FIG. 3.
Figure 11:
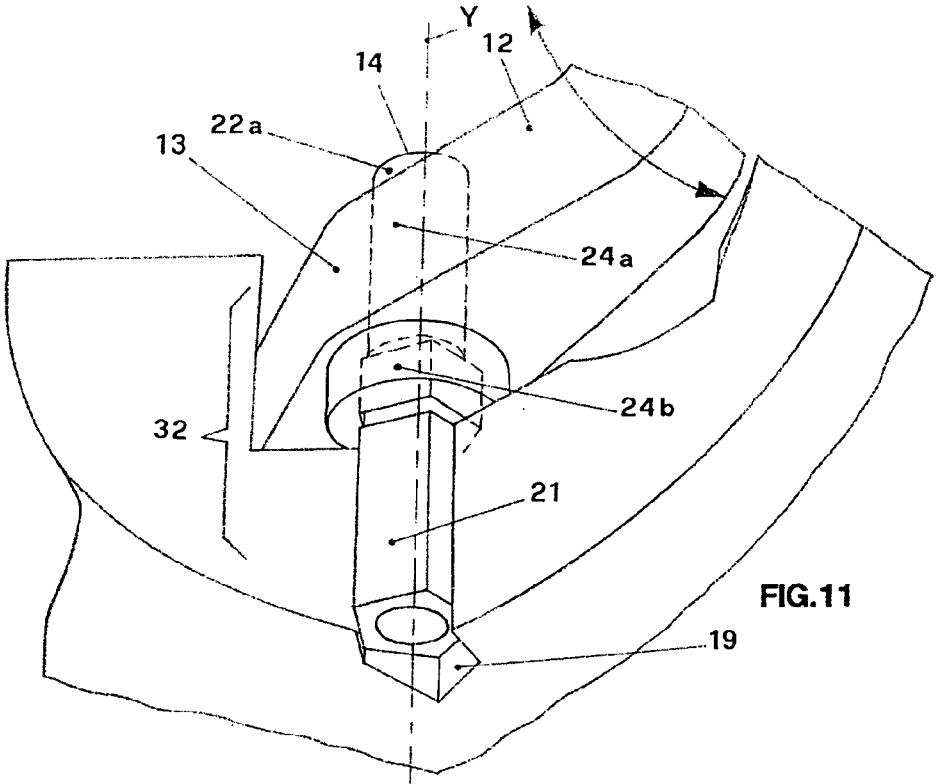
Figure 12:
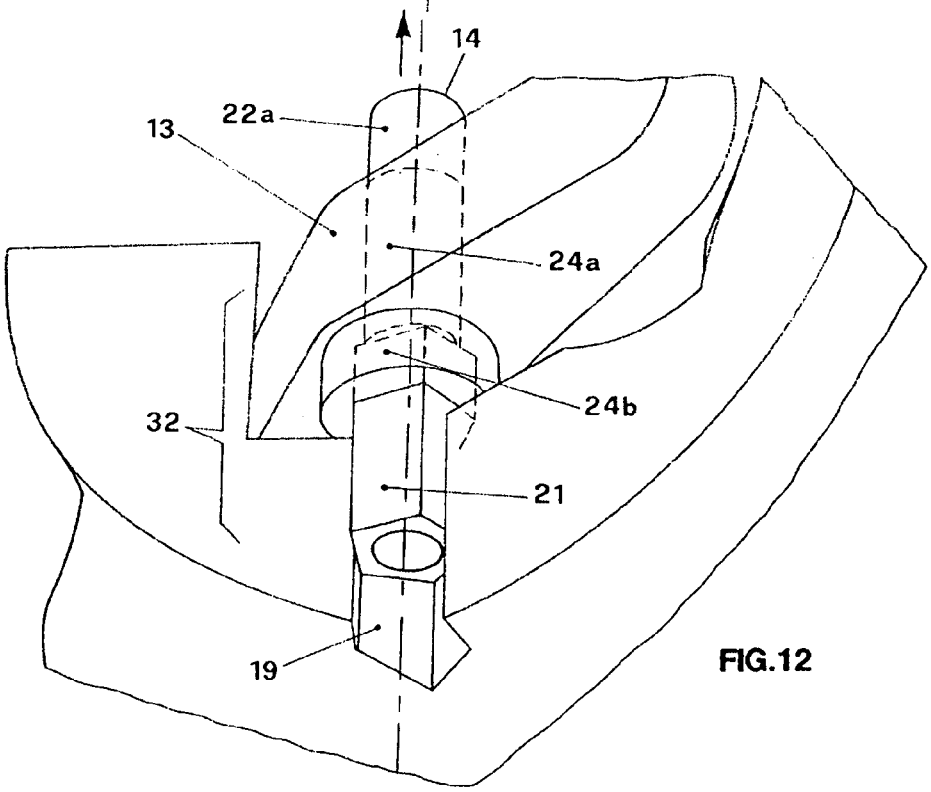
Figure 13:
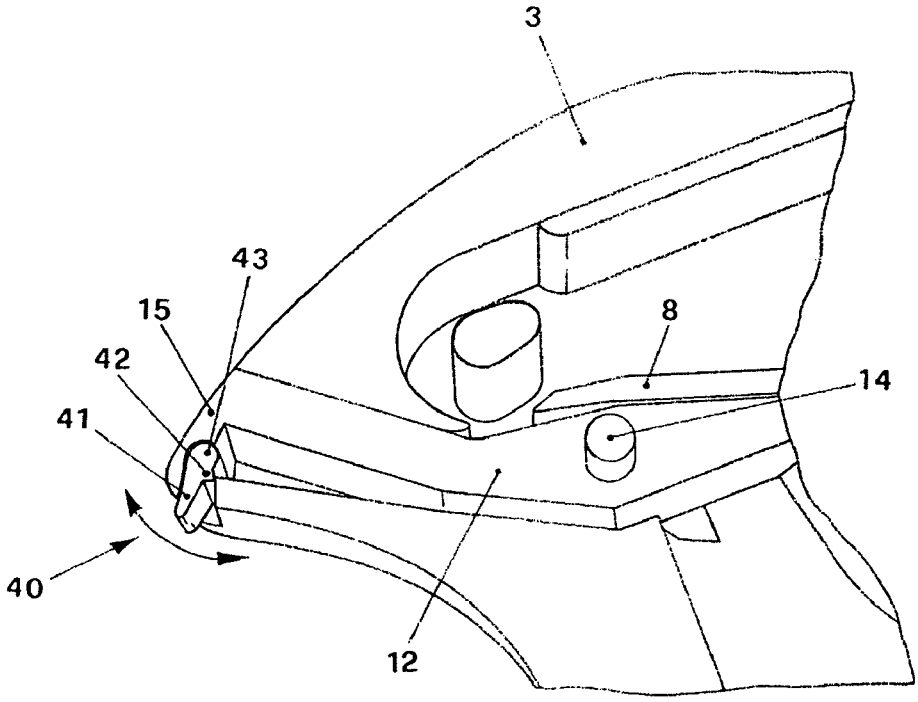
Figure 16:
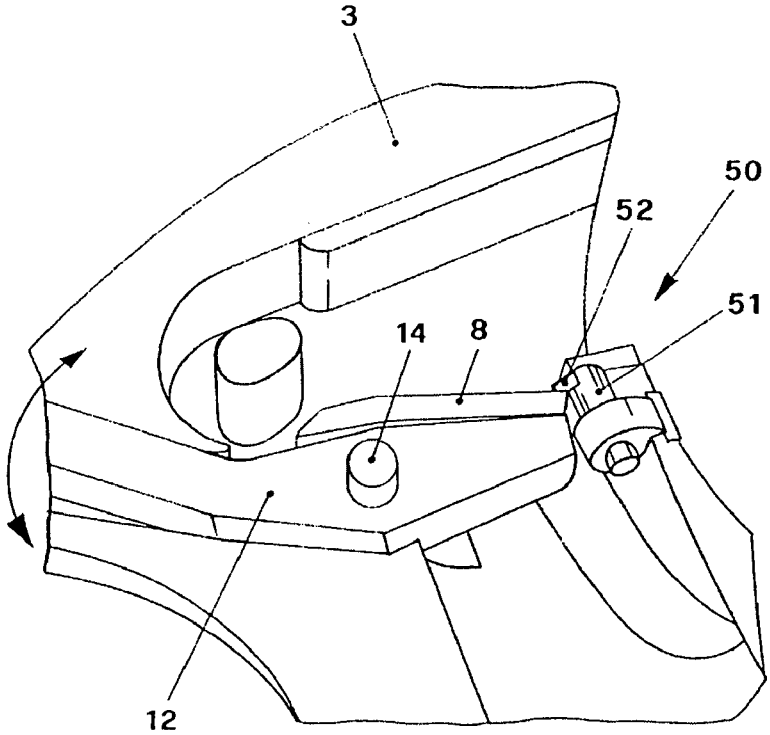
Figure 15:
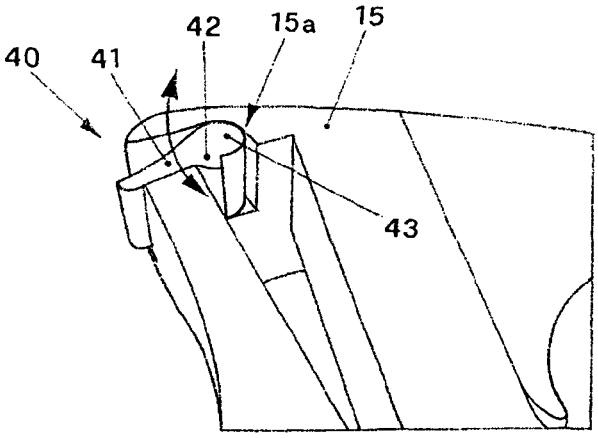
Figure 14:
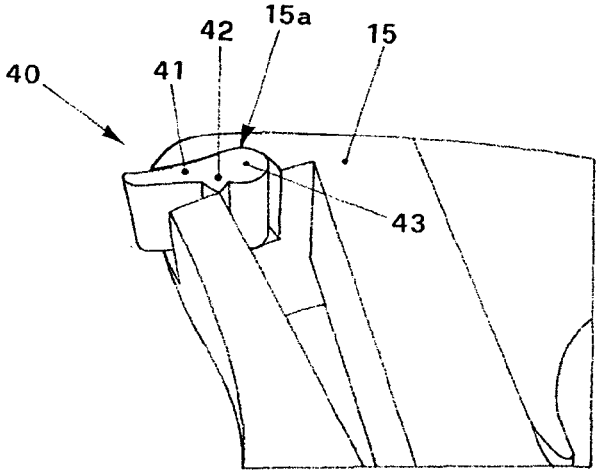
Figure 17:
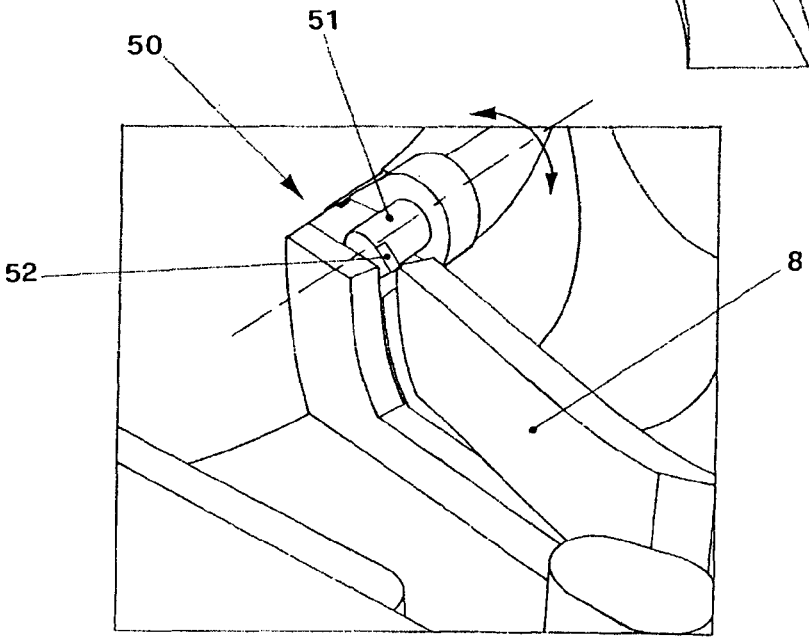

FIGS. from 6 to 10 show several axonometric views of details of FIGS. 4 and 5;

FIGS. 11 and 12 show the locking means that ensure the stability of the connection of the wrist strap to the handgrip, in two different positions;

FIG. 13 shows a construction variant of the locking means;

FIGS. 14 and 15 show some details of the construction variant of the locking means of FIG. 13, in two different positions;

FIG. 16 shows a further construction variant of the locking means;

FIG. 17 shows a detail of the further construction variant of the locking means of FIG. 16.

DESCRIPTION OF THE INVENTION

The coupling and releasing device that is the subject of the invention is shown in FIGS. from 1 to 3, where it is indicated as a whole by 1, and it connects and releases the wrist strap 2 to/from the handgrip 3 of a pole 4 for sporting activities, like for example skiing, trekking and the like.

As can be observed in the above mentioned figures, the device 1 comprises a buckle 5 associated with the wrist strap 2 and a seat 6 created in the handgrip 3 to house the above mentioned buckle 5.

The buckle 5 is provided with coupling means indicated as a whole by 7 that allow it to be permanently joined to the handgrip 3 once it has been inserted in the seat 6 that houses it.

Said coupling means 7, as shown in particular in FIGS. 4 and 5, comprise an elastic tab 8 projecting from the body 9 of the buckle 5 and a support surface 10, obtained in the seat 6, that cooperate by mutual contact when the buckle 5 is constrained inside the seat 6.

The invention includes means for releasing the buckle 5 from the handgrip 3, indicated as a whole by 11, that are maneuvered by the user and that according to the invention comprise a release lever 12 also housed in the seat 6.

In particular, the release lever 12 can be rotated around a rotation pin 14 and comprises a central core 13 including the rotation pin 14, a maneuvering end 15 that can be reached by the user and a release end 16 that cooperates by contact with the elastic tab 8.

Figure 6:
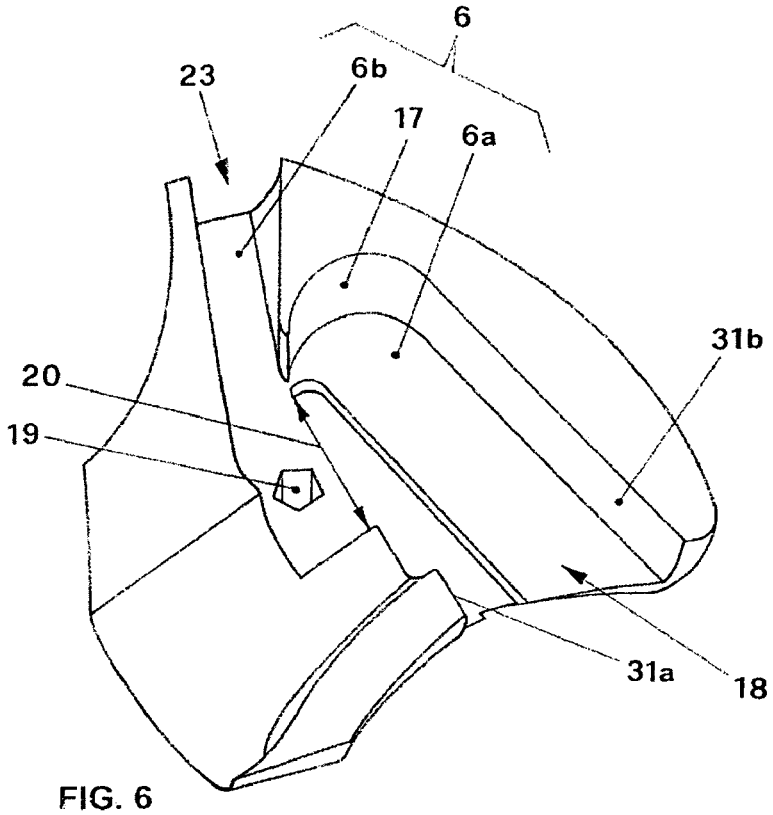
Figure 7:
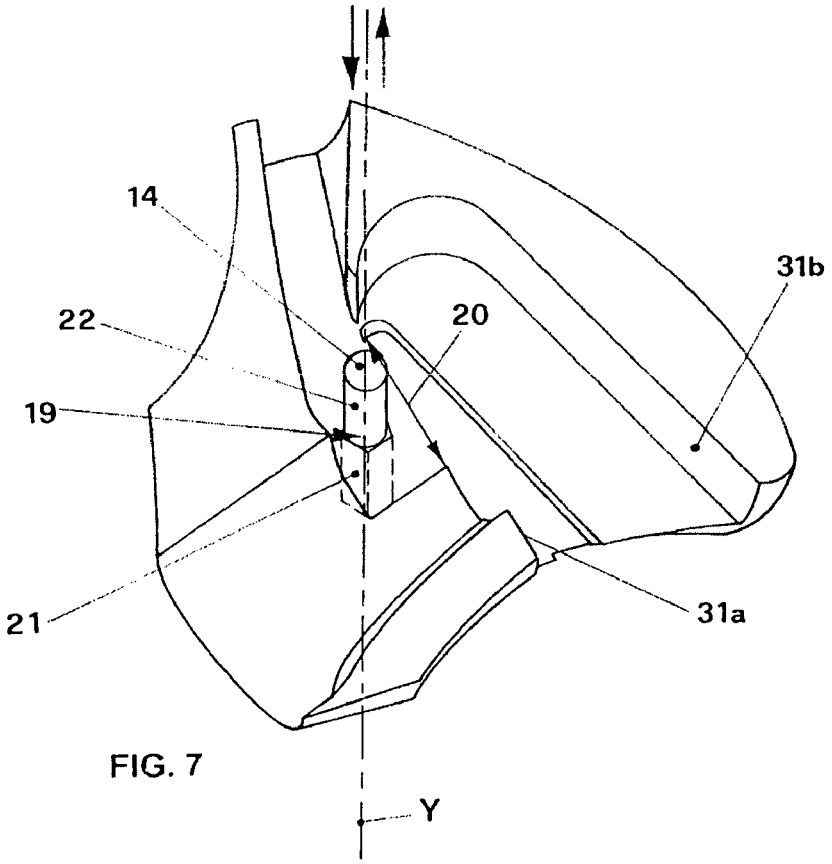

It can be observed in particular in FIGS. 6 and 7 that the seat 6 is created in the top end of the handgrip 3 and comprises a first area **6*a* where it is possible to identify a concave bottom 17 and a first opening 18 for fitting the buckle 5, and a second area 6*b* that houses the release lever 12, where it is possible to identify a seat 19 that houses the rotation pin 14 and a second opening 23 from which the maneuvering end 15 of the release lever 12** projects.

An intermediate opening 20 places the first area **6*a* in communication with the second area 6*b* and is obtained at the level of the seat 19 that houses the rotation pin 14**.

In particular, with reference to FIG. 7, the rotation pin 14 can slide along the rotation axis Y defined by it, in both the directions indicated by the arrows. It is also provided with a first prism-shaped portion 21 that fits in the seat 19 that, as shown in FIG. 6, has polygonal section matching with the prismatic shape of the first portion 21.

Figure 10:
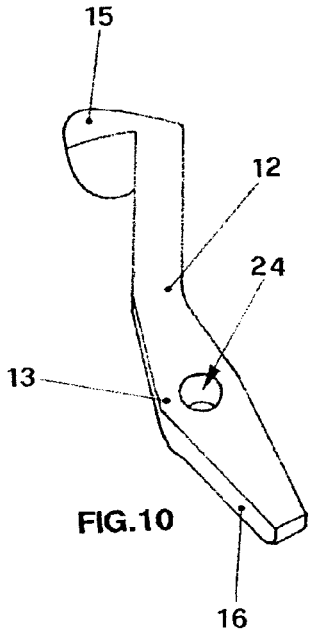

A second portion 22 of the rotation pin 14, instead, has the shape of a cylinder and fits in a first part 24*a* with circular section of a through hole 24 made in the central core 13 of the release lever 12 visible in FIG. 10 and in FIGS. 11 and 12.

Finally, the second portion 22 of the rotation pin 14 presents, as shown in particular in FIGS. 4 and 5, the free end 22*a* that projects from the through hole 24 beyond the release lever 12.

Figure 9:
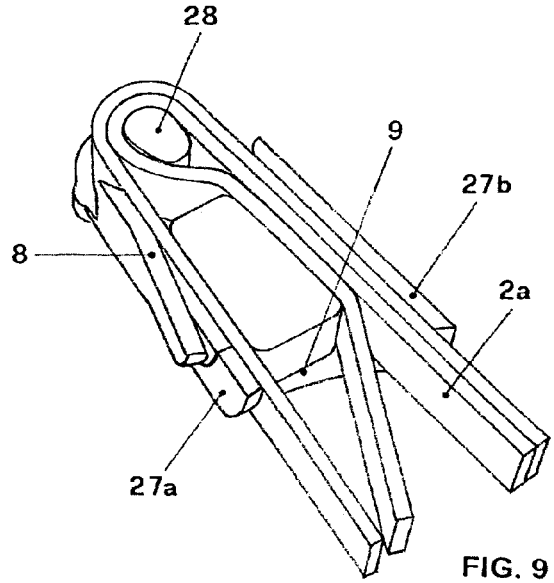
Figure 8:
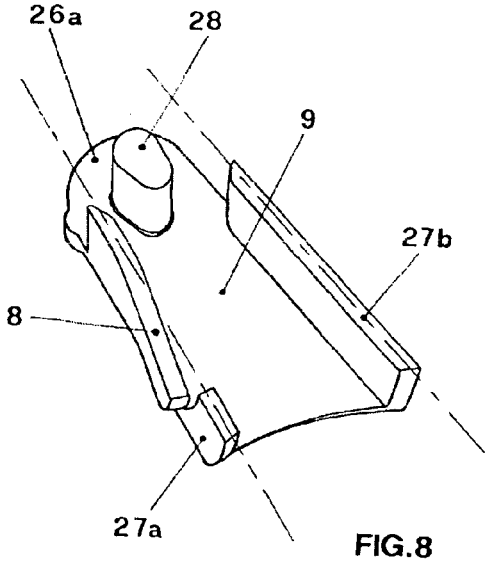

As regards in particular the buckle 5, it features, as shown in FIGS. 8 and 9, the shaped body 9 delimited by a rounded end 26*a* and by side walls 27*a*, 27*b*, one of which, more precisely the side wall indicated by 27*a*, is provided with the elastic tab 8.

A shaped core 28 projecting from the shaped body 9 of the buckle 5 shown in FIG. 8 is used to wind up the strip 2*a* of the wrist strap 2 as shown in FIG. 9. When the buckle 5 is inserted in the first area 6*a* of the seat 6 with the rounded end 26*a* matching the concave bottom 17, the elastic tab 8 comes at the level of the intermediate opening 20 and projects towards the second area 6*b* in such a way as to face and rest against the support surface 10 obtained in the seat 6.

This prevents the buckle 5 from being extracted after insertion.

It can also be observed that the side walls 27*a*, 27*b* are positioned against corresponding guide surfaces 31*a*, 31*b* present in the first area 6*a*, so that the buckle 5 is inserted by a guided sliding action.

Means 32 are also provided for locking the rotation of the release lever 12, thus preventing any accidental release of the buckle 5.

These are visible in FIGS. 11 and 12 and comprise a second portion 24*b* with polygonal section obtained in the through hole 24 made in the central core 13 of the release lever 12, which houses the first prismatic portion 21 of the rotation pin 14, when this is shifted upwards along the rotation axis Y defined by it, as shown by the arrow in FIG. 12.

More precisely, FIG. 11 illustrates the condition in which the first prismatic portion 21 of the pin 14 fits in the seat 19 whose polygonal section matches the prismatic shape of the first portion 21 of the pin 14, while the second portion 22 of the pin 14, cylindrical in shape, fits in the first part 24*a* of the through hole 24 made in the central core 13 of the release lever 12.

In this configuration, the pin 14 cannot rotate around the longitudinal axis Y defined by it, while the release lever 12 is free to rotate around it. On the other hand, in the configuration shown in FIG. 12, where the pin 14 is lifted upwards, a section of its first prismatic portion 21 fits in the second part 24*b* with polygonal section obtained in the through hole 24 made in the central core 13 of the release lever 12.

The rotation of the release lever 12 is thus prevented and it is impossible to release the buckle 5 from the handgrip 3.

According to a construction variant shown in FIGS. from 13 to 15, the locking means, indicated as a whole by 40, comprise a rotating pawl 41 that can be maneuvered by the user, associated with the handgrip 3 through a rotation pin 42 and provided with a shaped portion 43 that can be rotated in the directions indicated by the arrows and thus be inserted in a corresponding shaped recess 15*a* made in the maneuvering end 15 of the release lever 12.

When the shaped portion 43 is inserted in the corresponding cavity 15*a* as shown in FIG. 14, the release lever 12 cannot be rotated in any way.

Turning the rotating pawl 41 in the direction indicated by the arrow shown in FIG. 15 moves the shaped portion 43 out of the shaped recess 15*a* and allows the release lever 12 to be rotated.

According to a further construction variant that can be observed in FIGS. 16 and 17, the locking means, indicated as a whole by 50, are constituted by a rotary body 51 that can be rotated in the directions indicated by the arrows and is associated with the handgrip 3.

A projection 52 can be positioned in contact with the elastic tab 8 to prevent it from yielding when the user maneuvers the release lever 12.

It is evident that when the rotary body 51 is rotated and the projection 52 does not interfere with the elastic tab 8 the buckle 5 can be released again.

In practice, when the user intends to connect the wrist strap 2 to the handgrip 3 of the pole 4, he/she fits the buckle 5 in the first opening 17 of the first area 6*a* of the seat 6.

This operation is easier for the user owing to the centering action provided by the side walls 27*a*, 27*b* of the buckle 5 that, as shown in particular in FIG. 8, converge towards the rounded end 26*a* of the shaped body 26 of the buckle 5 and slide against the corresponding guide surfaces 31*a*, 31*b* that delimit the first area 6*a* of the seat 6.

During insertion, the elastic tab 8 is compressed due to the pressure exerted against the corresponding guide surface 31*a* and when the buckle 5 is completely inserted the elastic tab 8, due to a spontaneous elastic recovery effect, widens again and comes into contact with the support surface 10 as shown in FIG. 4 and against the release end 16 of the release lever 12.

In particular the latter, inside the second area 6*b* that houses it, is subjected to the counteracting action of an elastic element 35 that may consist of a spring, an elastomer or other means suited to make its rotation elastically yielding.

According to a different embodiment of the invention not illustrated in the drawings, the rotation of the release lever 12 can be made elastically yielding by providing for both the rotation pin and the through hole made in the release lever that houses it to be prismatic for their entire length.

In this case the elasticity of the rotation of the release lever will be ensured by the intrinsic elasticity of the material making up the rotation pin around which the lever cannot rotate, but will twist the pin when the lever is operated by the user.

If the user intends to prevent the buckle 5 from being released, he/she uses the locking means by axially shifting the pin 14 or turning the pawl 41 or the rotary body 51, depending on the construction variant according to which the locking means are carried out.

To release the buckle 5 from the handgrip 3 it is sufficient for the user to disengage the locking means, if necessary, and then to operate the maneuvering end 15 of the release lever 12 by rotating it in the direction indicated by the arrow that can be observed in FIG. 5.

The thrust exerted by the release end 16 against the elastic tab 8 compresses the latter, releasing it from contact with the support surface 10, in such a way as to allow the user to separate it from the handgrip 3 by applying a traction force to the buckle 5 in the direction indicated by the arrow, as shown in FIG. 5. The above clearly shows first of all that the construction of the device of the invention is simple, since all the parts and components that comprise it can be produced through a plastic moulding process.

The embodiment is such that inserting the buckle is simple even in the difficult conditions of use in which the user carries out the required operations, that is, with his/her hands protected by gloves.

Furthermore, the fact that the release action results from a pressure exerted by the rotation of a lever controlled by the user ensures that the release can always take place, while this may not happen in devices of known type where for the release to be obtained it is necessary to exceed an elastic locking load due to the mutual contact between counteracting means that may break and not allow the buckle to be separated from the handgrip.

The presence of the means suited to lock the rotation of the lever prevents any accidental release due, for example, to wrong maneuvers or abrupt and sudden movements in case of fall.

In the light of the above considerations, the device of the invention achieves all the previously-stated objects.

In the construction phase, further modifications can be made, which are neither represented nor described herein, but which must all be considered protected by the present patent if they fall within the scope of the following claims.

The invention claimed is:

1. Device for coupling and releasing the wrist strap to/from the handgrip of a pole for sporting activities, comprising:

a buckle with which said wrist strap is associated;

a seat obtained in said handgrip and suited to house said buckle;

means for coupling said buckle, comprising at least one elastic tab projecting from the body of said buckle and a support surface obtained in said seat that cooperate by mutual contact when said buckle is constrained to said handgrip; and means for releasing said buckle that can be manoeuvered by the user;

wherein said releasing means comprise a release lever that can be manoeuvered by the user and is housed inside said seat, wherein in said release lever it is possible to identify a central core with a rotation pin, a manoeuvring end that can be reached by the user and a release end that cooperates by contact with said elastic tab to move it away from said support surface;

wherein said seat is obtained in the too end of said handgrip and comprises:

a first area in which it is possible to identify a first opening for the insertion of said buckle;

a second area that houses said release lever and in which it is possible to identify a seat that houses said pin and a second opening from which said manoeuvring end of said release lever projects; and an intermediate opening that places said first area in communication with said second area, created at the level of said seat that houses said pin; and wherein said pin can slide along the rotation axis defined by it and presents a first prismatic portion that fits in said seat whose polygonal section is matched with said prismatic shape, and a second cylindrical portion that fits in a first part with circular section of a through hole made in said central core of said release lever, said second part having the free end that projects from said through hole.

2. Coupling and releasing device according to claim 1, wherein said buckle comprises a shaped body delimited by a rounded end and by side walls on one of which said elastic tab is provided, wherein on said shaped body it is possible to identify a shaped core projecting from the shaped body for winding a strip belonging to said wrist strap.

3. Coupling and releasing device according to claim 1, wherein it comprises means suited to lock the rotation of said release lever that include a rotating pawl that can be manoeuvred by the user, associated with said handgrip through a rotation pin and provided with a shaped portion that can be inserted by rotation into a corresponding shaped cavity made in said manoeuvring end of said release lever.

4. Coupling and releasing device according to claim 3, wherein it comprises yielding means cooperating with said release lever and suited to make the rotation of said lever elastic.

5. Coupling and releasing device according to claim 1, wherein it comprises means suited to lock the rotation of said release lever and including a rotary body that can be manoeuvred by the user and is associated with said handgrip, provided with a projection that comes into contact with said elastic tab to prevent it from yielding elastically.

6. Coupling and releasing device according to claim 5, wherein it comprises yielding means cooperating with said release lever and suited to make the rotation of said lever elastic.

7. Coupling and releasing device according to claim 1, wherein it comprises means suited to lock the rotation of said release lever and including a second part with polygonal section obtained in said through hole made in said central core of said release lever that houses a first prismatic section of said pin, when said pin is shifted along said axis of rotation defined by it.

8. Coupling and releasing device according to claim 7, wherein it comprises yielding means cooperating with said release lever and suited to make the rotation of said lever elastic.

9. Coupling and releasing device according to claim 1, wherein it comprises yielding means cooperating with said release lever and suited to make the rotation of said lever elastic.

10. Coupling and releasing device according to claim 9, wherein said yielding means are interposed between said release lever and said seat in which said lever is housed.

11. Coupling and releasing device according to claim 1, wherein it comprises yielding means cooperating with said release lever and suited to make the rotation of said lever elastic.

12. Coupling and releasing device according to claim 1, wherein it comprises yielding means cooperating with said release lever and suited to make the rotation of said lever elastic.

13. Device for coupling and releasing the wrist strap to/from the handgrip of a pole for sporting activities, comprising:

a buckle with which said wrist strap is associated;

a seat obtained in said handgrip and suited to house said buckle;

means for coupling said buckle, comprising at least one elastic tab projecting from the body of said buckle and a support surface obtained in said seat that cooperate by mutual contact when said buckle is constrained to said handgrip; and means for releasing said buckle that can be manoeuvred by the user;

wherein said releasing means comprise a release lever that can be manoeuvred by the user and is housed inside said seat, wherein in said release lever it is possible to identify a central core with a rotation pin, a manoeuvring end that can be reached by the user and a release end that cooperates by contact with said elastic tab to move it away from said support surface;

wherein said seat is obtained in the too end of said handgrip and comprises:

a first area in which it is possible to identify a first opening for the insertion of said buckle;

a second area that houses said release lever and in which it is possible to identify a seat that houses said pin and a second opening from which said manoeuvring end of said release lever projects; and an intermediate opening that places said first area in communication with said second area, created at the level of said seat that houses said pin;

wherein said buckle comprises a shaped body delimited by a rounded end and by side walls on one of which said elastic tab is provided, wherein on said shaped body it is possible to identify a shaped core projecting from the shaped body for winding a strip belonging to said wrist strap; and wherein said side walls are arranged against corresponding guide surfaces present in said first area when said buckle is inserted in said first opening of said first area of said seat.

14. Coupling and releasing device according to claim 13, wherein said elastic tab is arranged at the level of said intermediate opening of said seat and projects towards said second area of the seat when said buckle is inserted in said first said area of said seat.

15. Coupling and releasing device according to claim 13, wherein it comprises yielding means cooperating with said release lever and suited to make the rotation of said lever elastic.

16. Device for coupling and releasing the wrist strap to/from the handgrip of a pole for sporting activities, comprising:

a buckle with which said wrist strap is associated;

a seat obtained in said handgrip and suited to house said buckle;

means for coupling said buckle, comprising at least one elastic tab projecting from the body of said buckle and a support surface obtained in said seat that cooperate by mutual contact when said buckle is constrained to said handgrip; and means for releasing said buckle that can be manoeuvred by the user;

wherein said releasing means comprise a release lever that can be manoeuvred by the user and is housed inside said seat, wherein in said release lever it is possible to identify a central core with a rotation pin, a manoeuvring end that can be reached by the user and a release end that cooperates by contact with said elastic tab to move it away from said support surface;

wherein it comprises yielding means cooperating with said release lever and suited to make the rotation of said lever elastic;

wherein said yielding means are interposed between said release lever and said seat in which said lever is housed; and wherein said yielding means consist of a prismatic rotation pin fitted in a prismatic hole made in said release lever, said prismatic pin being made of a material that elastically yields to torsion.

17. Coupling and releasing device according to claim 16, wherein said yielding means further consist of at least one spring.

18. Coupling and releasing device according to claim 16, wherein said yielding means further consist of at least one elastomer.

19. Coupling and releasing device according to claim 16, wherein it comprises yielding means cooperating with said release lever and suited to make the rotation of said lever elastic.

* * * * *